US012262822B1

(12) United States Patent
Zheng

(10) Patent No.: US 12,262,822 B1
(45) Date of Patent: Apr. 1, 2025

(54) LUMINOUS GLASS DISPLAY SHELF

(71) Applicant: ODK TECHNOLOGY PTE. LTD., Singapore (SG)

(72) Inventor: Hongbing Zheng, Singapore (SG)

(73) Assignee: ODK TECHNOLOGY PTE. LTD., Singapore (SG)

( * ) Notice: Subject to any disclaimer, the term of this patent is extended or adjusted under 35 U.S.C. 154(b) by 0 days.

(21) Appl. No.: 18/815,127

(22) Filed: Aug. 26, 2024

(30) Foreign Application Priority Data

Aug. 7, 2024 (CN) ..... 202421900482.1

(51) Int. Cl.
*A47F 3/00* (2006.01)
*A47F 5/00* (2006.01)

(52) U.S. Cl.
CPC ..... *A47F 3/001* (2013.01); *A47F 5/0043* (2013.01)

(58) Field of Classification Search
CPC ..... A47F 3/001; A47F 5/0043; F25D 27/00
See application file for complete search history.

(56) References Cited

U.S. PATENT DOCUMENTS

2004/0264160 A1* 12/2004 Bienick ..... F25D 27/00 362/23.15
2009/0021927 A1* 1/2009 Hall ..... F25D 27/00 362/92
2015/0023000 A1* 1/2015 Kendall ..... F25D 25/02 362/249.02

* cited by examiner

*Primary Examiner* — Thomas M Sember
(74) *Attorney, Agent, or Firm* — Schwegman Lundberg & Woessner. P.A.

(57) ABSTRACT

A luminous glass display shelf which includes a plurality of upright posts and a plurality of mounting frames mounted with supporting plates. The plurality of mounting frames are vertically distributed at intervals and are respectively connected among the plurality of upright posts. Each of the plurality of mounting frames includes a hollow tube body, and a LED strip electrically connected with a power supply assembly is mounted in the tube body. A tube wall of the tube body is at least partially formed with a light-transmitting surface to transmit light of the LED strip and generate luminous effect. The connector is inserted and connected with the frame, and the light-transmitting surface is made of the light-transmitting material, thus ensuring lighting effect of the display shelf when powered on. The connector and the upright post are fixed through the groove, which improves rigidity of the whole display frame structure.

14 Claims, 6 Drawing Sheets

LUMINOUS GLASS DISPLAY SHELF

CROSS REFERENCE TO THE RELATED APPLICATIONS

This Non-provisional application claims priority under 35 U.S.C. § 119 (a) to Chinese Patent Application No. CN202421900482.1 filed on Aug. 7, 2024, the entire content of which is hereby incorporated by reference.

TECHNICAL FIELD

The disclosure belongs to the technical field of commodity display shelves, in particular to a luminous glass display shelf.

BACKGROUND ART

A display shelf is a common household product for storing and placing articles at home, and is usually used for placing common ornaments, garage kits, utensils, handbags, toys, wine sets and other products at a corner of the house.

Currently, mainstream display shelves with lights are mostly spliced by bonding a wooden material or a steel frame to light strips. Because of high cost and self-weight of materials of plates and steel pipes, they are not dominant in the market and are very limited in modeling, which results in excessive homogenization, low cost performance and poor quality and assembly stability of products.

Therefore, in view of above problems, it is urgent to provide a display shelf with low weight, good economic benefits, high structural rigidity and good stability.

SUMMARY

An object of the disclosure is to provide a luminous glass display shelf, so as to solve problems of limited modeling, excessive homogenization and low cost performance of display shelves. The disclosure provides following technical schemes: a luminous glass display shelf includes a plurality of upright posts and a plurality of mounting frames mounted with supporting plates. The plurality of mounting frames are vertically distributed at intervals and are respectively connected among the plurality of upright posts.

Each of the plurality of mounting frames includes a hollow tube body, and a LED strip electrically connected with a power supply assembly is mounted in the tube body. A tube wall of the tube body is at least partially formed with a light-transmitting surface so as to transmit light of the LED strip and generate luminous effect.

The tube body includes four tube walls connected in pairs, and a cross section of the tube body is rectangular or square. Four tube walls are integrally formed, and at least one of the tube walls is made of a light-transmitting material.

A clamping groove is provided in the tube body along its extension direction, and the strip is mounted in the clamping groove. The tube body includes a plurality of sub-tube bodies. The mounting frame further includes connectors, and each of the connectors is connected with two adjacent sub-tube bodies, so that respective sub-tube bodies are connected end to end to form the mounting frame.

Each of the supporting plates is made of glass, and each of the connector is L-shaped. A pallet is provided at an inner side of a corner of the connector, and the glass plate is fixedly mounted to the pallet. A middle part of a groove is defined with a through hole penetrating through a body of the connector. An upper end of each of the plurality of upright posts is defined with a screw hole. A lower end of the upright post is provided with a nut. A screw is connected in the screw hole and the screw passes through the through hole and is fixedly connected with the nut in another upright post.

In this technical scheme, the tube body and the strip in this disclosure are made of plastic injection molding, the light-transmitting surface is made of the light-transmitting material, and the upright post is made of a steel material.

Before mounting of this product, it is necessary to slide the strip horizontally into the clamping groove, and it is hollow inside of the tube body, and at least one of its four surfaces is the light-transmitting surface, so as to ensure that light emitted by the strip radiates on displayed goods through the light-transmitting surface. When the product in this disclosure is mounted, firstly, a plug-in part is inserted at an end of the tube body, and the connectors are right-angled in shape. By using four groups of connectors and two groups of sub-tube bodies with a same length, its mounting frames are spliced end to end to form a rectangular frame structure.

When a plurality of frame structures are assembled, the screw is connected in the screw hole, an upper end of the upright post is aligned with the groove, and at this time, the welded screw extends from an upper end of the plug-in part through the through hole, the nut at a lower end of another upright post is aligned with the screw, the another upright post is rotated until it is clamped with an upper surface of the connector, and at this time, the two upright posts are tightly connected with the upper and lower ends of the connector into a whole. The whole commodity display shelf is made up of multi-layer frames stacked up and down, and the whole display shelf is finally built similarly through the above connection model.

The pallet is fixedly connected to the inner side of the corner of the connector, which has a function of a rib plate and can enhance structural rigidity of the whole connector. Connection between the pallet and the glass plate can be fixed by coating glue at a contact position of them, and it can also be fixed at a contact point of them by a soft double-sided adhesive tape. In this disclosure, an actual size of the glass plate is slightly smaller than a size of a frame obtained by connecting the tube body and the connector, to avoid the glass plate from being broken due to extrusion caused after the glass plate is tightly clamped with the frame.

In any of above technical schemes, further, the connector is L-shaped, including a connector body with a corner, and a plug-in part extending horizontally from the connector body in directions along both sides of the corner, respectively. The plug-in part is detachably inserted into an end of the sub-tube body. The connector body includes an upper end face and a lower end face, and the lower end face is provided with a groove.

A cross section of the upright post is the same as a cross section of the groove, and the upper end of the upright post is inserted into the groove.

In this technical scheme, it should be noted that shapes of cross-sections of the groove and the upright post are not limited to the rectangular shape, and other polygonal shapes can also be adopted, which is not specifically limited in this disclosure.

The shape of the groove is consistent with a cross-sectional area of the upright post. When the upper end of the upright post is mounted and embedded in the groove, the whole groove can limit freedom of rotation of the upright post, thus ensuring that the upright post placed at the lower end does not rotate with the connector to cause connection between the two upright posts to be unstable during a process of rotary connection between another upright post and the upper end of the connector.

In any of the above technical schemes, further, a bunching device is provided at an outer side of the tube wall of the tube body, and the bunching device includes a buckle fixed with the tube body, and a wire of the strip penetrates out of the tube wall of the tube body and is buckled in the buckle.

In the technical scheme, a power supply wire of the strip extends out of the tube body through the bunching device, a power supply wire of each layer of strip is led out through the buckle arranged at a side of each frame for the whole commodity display shelf, and lines of the strip extends out from an end of the frame of the lamp tube and is uniformly fixed to a back of the display shelf through the bunching device, thus realizing unified arrangement and control of a plurality of strips. The operator can realize uniform power on and off only through a switch, thus realizing power supply and lighting for the whole display shelf.

The disclosure has beneficial effects that the tube body and the light-transmitting surface in the disclosure adopt a double-material profile process, and the tube body and the connector are made of plastic, which has characteristics of low weight, high strength and high economic benefit. The connector is inserted and connected with the frame, and the light-transmitting surface is made of the light-transmitting material, thus ensuring lighting effect of the layered frame of the display shelf after the strip is powered on. Secondly, the provided connector and upright post are fixed in an inserted mode through the groove, and this assembling mode is firm and improves rigidity and stability of the whole display frame structure. The bunching device arranged on the back of the frame is further used to realize unified storage and arrangement of the lines of the strip, which makes the whole product more concise and beautiful.

DETAILED DESCRIPTION

Figure 1:
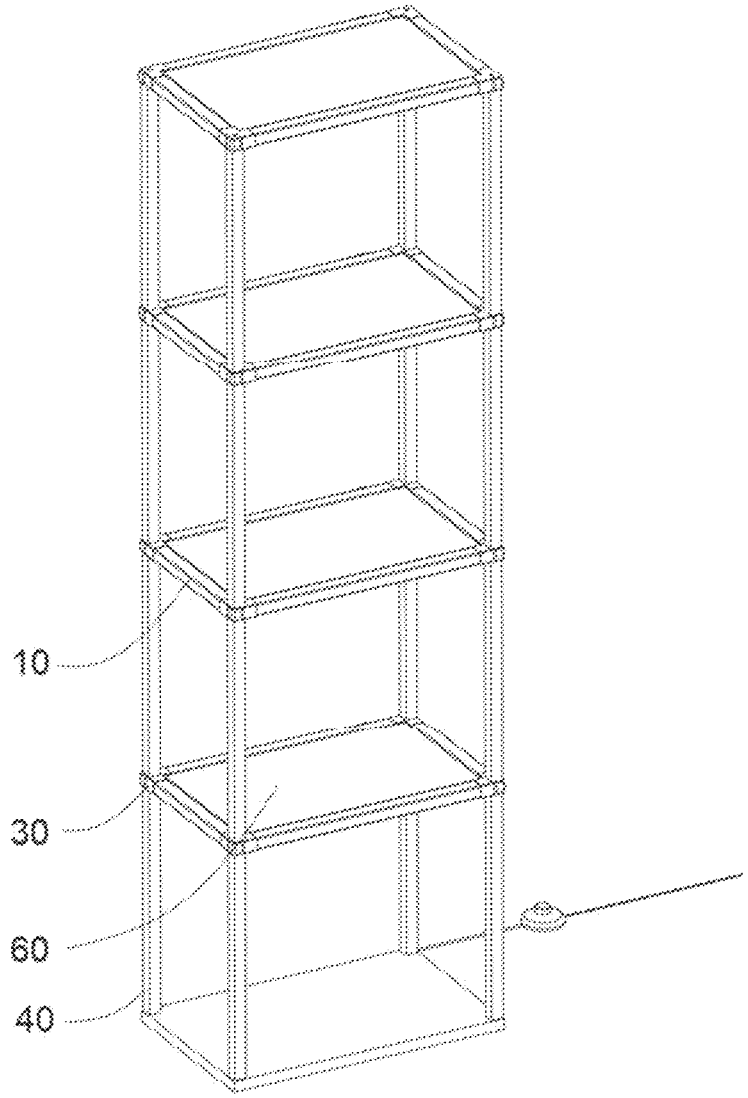
FIG. 1 is a schematic view of an appearance of the disclosure.
Figure 2:
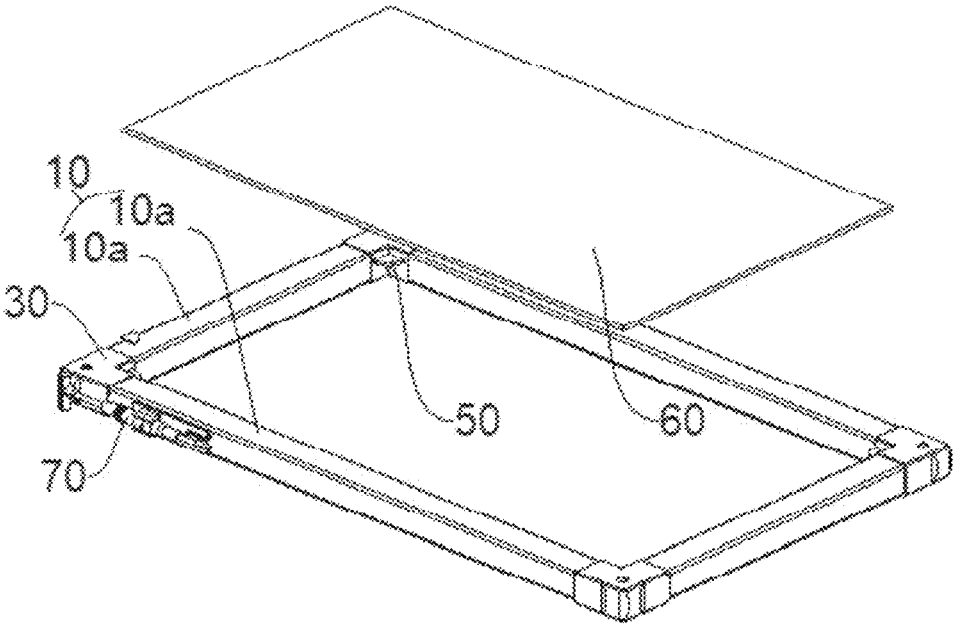
FIG. 2 is a schematic view of an appearance of a mounting frame according to the disclosure.

In the following, technical schemes in the embodiments of the disclosure will be described clearly in connection with the drawings; obviously, described embodiments is intended to be only a part of embodiments of the disclosure, but not all of them. On a basis of the embodiments in this disclosure, all other embodiments obtained by the ordinary skilled in the art are within the protection scope of this disclosure.

Embodiment 1

As shown in FIGS. 1 to 5, a luminous glass display shelf is provided in this embodiment, which includes:

a plurality of upright posts 40 and a plurality of mounting frames 60 mounted with supporting plates. The plurality of mounting frames are vertically distributed at intervals and are respectively connected among the plurality of upright posts 40. The luminous glass display shelf is characterized in that:

each of the plurality of mounting frames includes a hollow tube body 10, and a LED strip 20 electrically connected with a power supply assembly is mounted in the tube body 10; and A tube wall of the tube body 10 is at least partially formed with a light-transmitting surface 11 so as to transmit light of the LED strip 20 and generate luminous effect.

The tube body 10 includes four tube walls connected in pairs, and a cross section of the tube body 10 is rectangular or square. Four tube walls are integrally formed, and at least one of the tube walls is made of a light-transmitting material.

A clamping groove 12 is provided in the tube body 10 along its extension direction, and the strip 20 is mounted in the clamping groove 12. The tube body 10 includes a plurality of sub-tube bodies. The mounting frame further includes connectors 30, and each of the connectors 30 is connected with two adjacent sub-tube bodies, so that respective sub-tube bodies are connected end to end to form the mounting frame.

Each of the supporting plates 60 is made of glass, and each of the connector 30 is L-shaped. A pallet 50 is provided at an inner side of a corner of the connector 30, and the glass plate 60 is fixedly mounted to the pallet 50. A middle part of a groove 32 is defined with a through hole 33 penetrating through a body of the connector. An upper end of each of the plurality of upright posts 40 is defined with a screw hole 42. A lower end of the upright post 40 is provided with a nut 41. A screw is connected in the screw hole 42 and the screw passes through the through hole 33 and is fixedly connected with the nut 41 in another upright post 40.

In this technical scheme, the tube body 10 and the strip 20 in this disclosure are made of plastic injection molding, the light-transmitting surface 11 is made of the light-transmitting material, and the upright post 40 is made of a steel material.

Before mounting of this product, it is necessary to slide the strip 20 horizontally into the clamping groove 12, and it is hollow inside of the tube body 10, and at least one of its four surfaces is the light-transmitting surface, so as to ensure that light emitted by the strip 20 radiates on displayed goods through the light-transmitting surface 11. When the product in this disclosure is mounted, firstly, a plug-in part 31 is inserted at an end of the tube body 10, and the connectors 30 are right-angled in shape. By using four groups of connectors 30 and two groups of sub-tube bodies with a same length, its mounting frames are spliced end to end to form a rectangular frame structure.

When a plurality of frame structures are assembled, the screw 42 is connected in the screw hole, an upper end of the upright post 40 is aligned with the groove 32, and at this time, the welded screw extends from an upper end of the plug-in part 31 through the through hole 33, the nut 41 at a lower end of another upright post 40 is aligned with the screw, the another upright post 40 is rotated until it is clamped with an upper surface of the connector 30, and at this time, the two upright posts 40 are tightly connected with the upper and lower ends of the connector 30 into a whole. The whole commodity display shelf is made up of multi-layer frames stacked up and down, and the whole display shelf is finally built similarly through the above connection model.

The pallet 50 is fixedly connected to the inner side of the corner of the connector 30, which has a function of a rib plate and can enhance structural rigidity of the whole connector 30. Connection between the pallet 50 and the glass plate 60 can be fixed by coating glue at a contact position of them, and it can also be fixed at a contact point of them by a soft double-sided adhesive tape. In this disclosure, an actual size of the glass plate 60 is slightly smaller than a size of a frame obtained by connecting the tube body 10 and the connector 30, to avoid the glass plate 60 from being broken due to extrusion caused after the glass plate 60 is tightly clamped with the frame.

Figure 3:
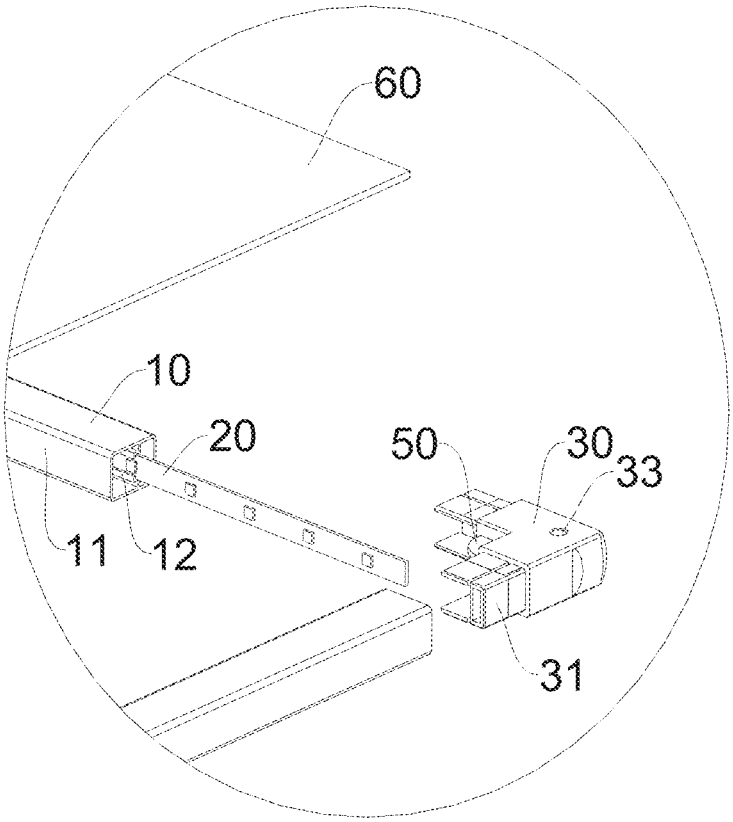
FIG. 3 is a schematic view of mounting of a frame and a strip according to the disclosure.
Figure 4:
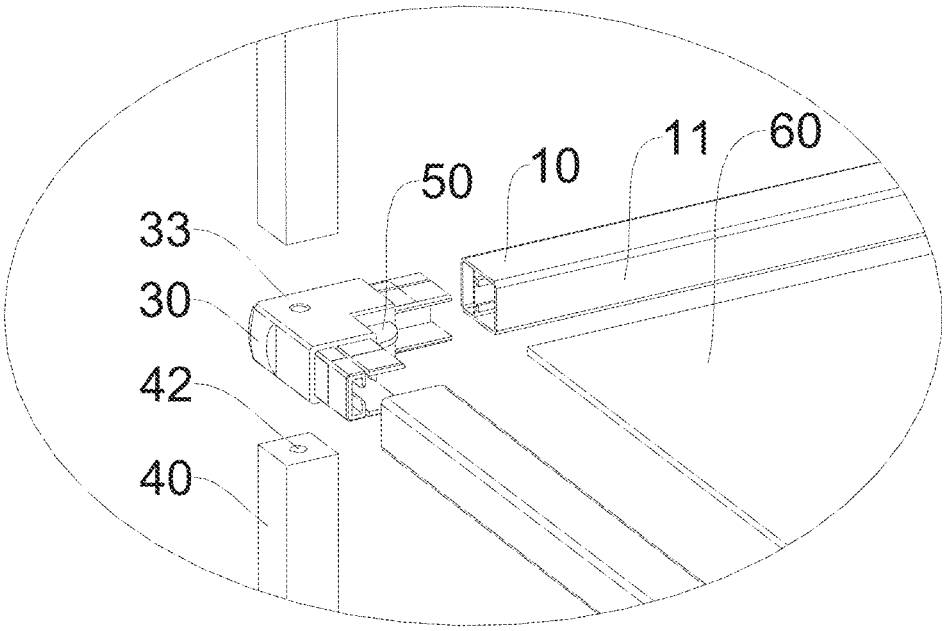
FIG. 4 is a schematic structural view of a connector and an upright post according to the disclosure.
Figure 5:
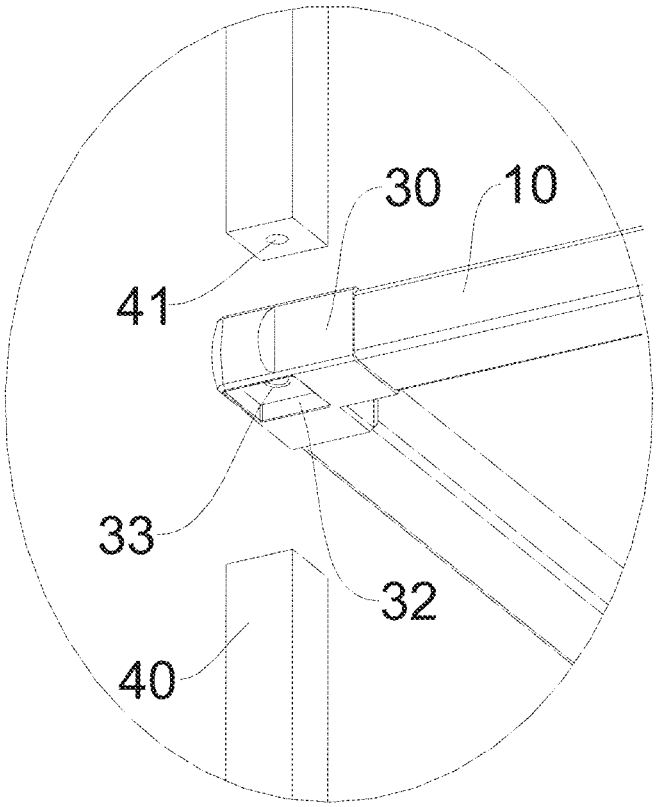
FIG. 5 is a schematic view of installation of the connector and the upright post according to the disclosure.

In a preferred embodiment of the disclosure:

As shown in FIGS. 3 to 5, specifically, the connector 30 is L-shaped, including a connector body with a corner, and a plug-in part 31 extending horizontally from the connector body in directions along both sides of the corner, respectively. The plug-in part 31 is detachably inserted into an end of the sub-tube body. The connector body includes an upper end face and a lower end face, and the lower end face is provided with a groove 32.

A cross section of the upright post 40 is the same as a cross section of the groove 32, and the upper end of the upright post 40 is inserted into the groove 32.

In this technical scheme, it should be noted that shapes of cross-sections of the groove 32 and the upright post 40 are not limited to the rectangular shape, and other polygonal shapes can also be adopted, which is not specifically limited in this disclosure.

The shape of the groove 32 is consistent with a cross-sectional area of the upright post 40. When the upper end of the upright post 40 is mounted and embedded in the groove 32, the whole groove 32 can limit freedom of rotation of the upright post 40, thus ensuring that the upright post 40 placed at the lower end does not rotate with the connector 30 to cause connection between the two upright posts 40 to be unstable during a process of rotary connection between another upright post 40 and the upper end of the connector 30.

Figure 6:
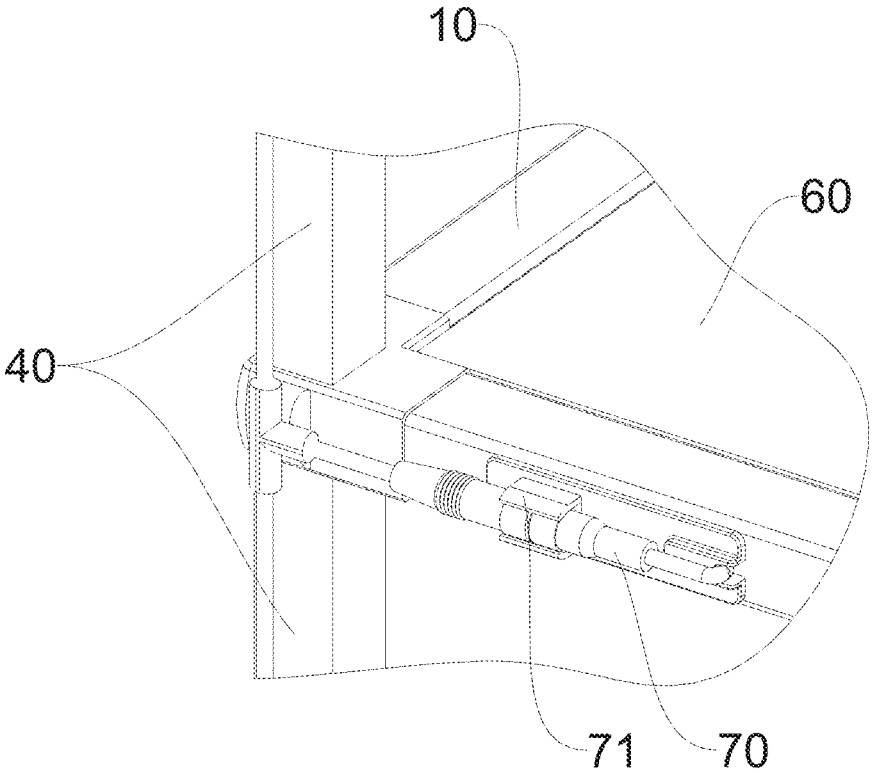
FIG. 6 is a schematic view of installation of the bunching device according to the disclosure.

In a preferred embodiment of the disclosure:

As shown in FIGS. 1 and 6, specifically, a bunching device 70 is provided at an outer side of the tube wall of the tube body 10, and the bunching device 70 includes a buckle 71 fixed with the tube body 10, and a wire of the strip 20 penetrates out of the tube wall of the tube body 10 and is buckled in the buckle 71.

In the technical scheme, a power supply wire of the strip 20 extends out of the tube body 10 through the bunching device 70, a power supply wire of each layer of strip 20 is led out through the buckle 71 arranged at a side of each frame for the whole commodity display shelf, and lines of the strip extends out from an end of the frame of the lamp tube and is uniformly fixed to a back of the display shelf through the bunching device 70, thus realizing unified arrangement and control of a plurality of strips. The operator can realize uniform power on and off only through a switch, thus realizing power supply and lighting for the whole display shelf.

Embodiments of this disclosure have been described above in combination with drawings. In case of no conflict, embodiments and features in the embodiments can be combined with each other. This disclosure is not limited to above specific embodiments, which are only schematic but not restrictive. Under inspiration of this disclosure, many forms can be made by ordinary skilled in the art without departing from the spirit of this disclosure and the protection scope of the claims, which all fall within the protection of this disclosure.

What is claimed is:

1. A luminous display shelf, comprising a plurality of upright posts and a plurality of mounting frames mounted with supporting plates, the plurality of mounting frames being vertically distributed at intervals and being respectively connected among the plurality of upright posts, wherein each of the plurality of mounting frames comprises a hollow tube body, and a LED strip electrically connected with a power supply assembly is mounted in the tube body; and a tube wall of the tube body is at least partially formed with a light-transmitting surface so as to transmit light of the LED strip and generate luminous effect;

wherein the tube body comprises a plurality of sub-tube bodies, the mounting frame further comprises connectors, and each of the connectors is connected with two adjacent sub-tube bodies, so that respective sub-tube bodies are connected end to end to form the mounting frame.

2. The luminous display shelf according to claim 1, wherein the tube body comprises four tube walls connected in pairs, and a cross section of the tube body is rectangular or square; and four tube walls are integrally formed, and at least one of the tube walls is made of a light-transmitting material.

3. The luminous display shelf according to claim 1, wherein the connector is L-shaped, comprising a connector body with a corner, and a plug-in part extending horizontally from the connector body in directions along both sides of the corner, respectively;

the plug-in part is detachably inserted into an end of the sub-tube body;

the connector body comprises an upper end face and a lower end face, and the lower end face is provided with a groove; and a cross section of the upright post is the same as a cross section of the groove, and the upper end of the upright post is inserted into the groove.

4. The luminous display shelf according to claim 3, wherein a middle part of a groove is defined with a through hole penetrating through a body of the connector, an upper end of each of the plurality of upright posts is defined with a screw hole, a lower end of the upright post is provided with a nut, a screw is connected in the screw hole and the screw passes through the through hole and is fixedly connected with the nut in another upright post.

5. The luminous display shelf according to claim 1, wherein each of the supporting plates is made of glass, and each of the connector is L-shaped, a pallet is provided at an inner side of a corner of the connector, and the glass plate is fixedly mounted to the pallet.

6. The luminous display shelf according to claim 1, wherein a clamping groove is provided in the tube body along its extension direction, and the strip is mounted in the clamping groove.

7. The luminous display shelf according to claim 1, wherein a bunching device is provided at an outer side of the tube wall of the tube body, and the bunching device comprises a buckle fixed with the tube body, and a wire of the strip penetrates out of the tube wall of the tube body and is buckled in the buckle.

8. A luminous display shelf, comprising a plurality of upright posts and a plurality of mounting frames mounted with supporting plates, the plurality of mounting frames being vertically distributed at intervals and being respectively connected among the plurality of upright posts, wherein each of the plurality of mounting frames comprises a hollow tube body, and a LED strip electrically connected with a power supply assembly is mounted in the tube body; and a tube wall of the tube body is at least partially formed with a light-transmitting surface so as to transmit light of the LED strip and generate luminous effect;

wherein a bunching device is provided at an outer side of the tube wall of the tube body, and the bunching device comprises a buckle fixed with the tube body, and a wire of the strip penetrates out of the tube wall of the tube body and is buckled in the buckle.

9. The luminous display shelf according to claim 8, wherein the tube body comprises four tube walls connected in pairs, and a cross section of the tube body is rectangular or square; and four tube walls are integrally formed, and at least one of the tube walls is made of a light-transmitting material.

10. The luminous display shelf according to claim 8, wherein the tube body comprises a plurality of sub-tube bodies, the mounting frame further comprises connectors, and each of the connectors is connected with two adjacent sub-tube bodies, so that respective sub-tube bodies are connected end to end to form the mounting frame.

11. The luminous display shelf according to claim 10, wherein the connector is L-shaped, comprising a connector body with a corner, and a plug-in part extending horizontally from the connector body in directions along both sides of the corner, respectively:

the plug-in part is detachably inserted into an end of the sub-tube body;

the connector body comprises an upper end face and a lower end face, and the lower end face is provided with a groove; and a cross section of the upright post is the same as a cross section of the groove, and the upper end of the upright post is inserted into the groove.

12. The luminous display shelf according to claim 11, wherein a middle part of a groove is defined with a through hole penetrating through a body of the connector, an upper end of each of the plurality of upright posts is defined with a screw hole, a lower end of the upright post is provided with a nut, a screw is connected in the screw hole and the screw passes through the through hole and is fixedly connected with the nut in another upright post.

13. The luminous display shelf according to claim 10, wherein each of the supporting plates is made of glass, and each of the connector is L-shaped, a pallet is provided at an inner side of a corner of the connector, and the glass plate is fixedly mounted to the pallet.

14. The luminous display shelf according to claim 8, wherein a clamping groove is provided in the tube body along its extension direction, and the strip is mounted in the clamping groove.

* * * * *